US006818701B2

(12) United States Patent
Ichikawa et al.

(10) Patent No.: US 6,818,701 B2
(45) Date of Patent: Nov. 16, 2004

(54) GOLF BALL

(75) Inventors: Yasushi Ichikawa, Chichibu (JP); Rinya Takesue, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 53 days.

(21) Appl. No.: 10/326,118

(22) Filed: Dec. 23, 2002

(65) Prior Publication Data

US 2003/0130424 A1 Jul. 10, 2003

(30) Foreign Application Priority Data

Dec. 26, 2001 (JP) ..... 2001-393782

(51) Int. Cl.[7] ..... A63B 37/12; C08L 83/04

(52) U.S. Cl. ..... 525/106; 525/101; 473/371; 473/374; 473/378; 473/385

(58) Field of Search ..... 525/101, 106; 528/32, 33, 35; 473/371, 374, 378, 385

(56) References Cited

U.S. PATENT DOCUMENTS

| | | | | |
|---|---|---|---|---|
| 6,270,429 | B1 * | 8/2001 | Sullivan | 473/374 |
| 2003/0119607 | A1 * | 6/2003 | Hayashi et al. | 473/371 |

FOREIGN PATENT DOCUMENTS

| | | | |
|---|---|---|---|
| JP | 60-258236 | A | 12/1985 |
| JP | 8-243191 | A | 9/1996 |
| JP | 9-220296 | A | 8/1997 |
| JP | 9-225066 | A | 9/1997 |
| JP | 2001-170213 | A | 6/2001 |
| JP | 2001353233 | * | 12/2001 |

* cited by examiner

*Primary Examiner*—David J. Buttner
(74) *Attorney, Agent, or Firm*—Sughrue Mion, PLLC

(57) ABSTRACT

A golf ball includes a portion formed from a golf ball-forming composition containing at least one kind selected from a crosslinked silicone rubber powder and a crosslinked silicone resin powder. Each of the crosslinked silicone rubber powder and the crosslinked silicone resin powder has an average particle size in a range of 60 to 500 $\mu$m. The golf ball is excellent in durability against repetitive hitting and adhesiveness of a coating film, and particularly, has a good resilience and a long flight distance in both a wide temperature range and a wide hitting head speed range.

7 Claims, No Drawings

GOLF BALL

BACKGROUND OF THE INVENTION

The present invention relates to a golf ball having a good durability against repetitive hitting and a good resilience even in a low temperature, and particularly to a golf ball with the reduced dependency of a hitting head speed on the flight distance (resilience) of the ball.

In conventional two-piece golf balls, cores have been typically formed from rubbers obtained by thermally crosslinking materials mainly containing highly resilient polybutadiene rubber by using peroxides and co-crosslinking agents such as methacrylic acid, and covers have been typically formed from ionomer resins being excellent in impact resistance and cut resistance and commercially available, for example, under the trade names of Surlyn and Himilan.

The two-piece golf balls produced by using the above-described materials are excellent in flight characteristic and durability; however, they must generally sacrifice a soft feel, which is very important to golf players.

To cope with such an inconvenience, efforts have been made to develop two-piece golf balls capable of giving a soft feel by making the core softer and the cover harder. These golf balls, however, tend to give rise to other problems associated with poor durability against repetitive hitting, insufficient resilience, and/or poor low-temperature performance.

In view of the foregoing, various examinations have been recently made to improve two-piece golf balls, and golf balls, each including a core and a cover, at least one of which is of a two-layer structure having one layer for enhancing resilience and the other layer for giving a soft feel, have been put into markets.

With respect to the above two-layer structure of a cover or a core of a two-piece golf ball, there occurs an inconvenience that the resilience of each of an ionomer resin used as the cover material and crosslinked polybutadiene used as the core material can be kept as desirable at a high hardness; however, the resilience tends to be reduced as the hardness becomes low. In addition, a polyurethane based elastomer, a polyamide based elastomer, a polyester based elastomer, and the like used for forming an intermediate layer for the cover, of a golf ball for giving a pleasant feel of hitting the ball have been required to be further improved in resilience and to be further reduced in dependency of temperature on hardness.

To further improve the resilience and reduce the dependency of temperature on hardness, an attempt has been made to blend millable type silicone rubber in polybutadiene rubber, followed by crosslinking the resultant rubber by using peroxide, as disclosed in Japanese Patent Laid-open No. Sho 60-258236.

The above-described material, however, has a problem associated with dispersion of silicone rubber in polybutadiene rubber and non-uniform reactivity therebetween, which leads to the reduced durability against hitting. Accordingly, it is very difficult to stably obtain a rubber material having excellent characteristic by blending silicone rubber in polybutadiene rubber.

Another attempt has been made to blend millable type silicone rubber in a core-forming rubber or a cover-forming resin, followed by dynamic crosslinking, as disclosed in Japanese Patent Laid-open Nos. Hei 8-243191, Hei 9-220296, and Hei 9-225066. These blends, however, have problems associated with the extremely reduced flowability to the extent that injection molding thereof becomes difficult, the non-uniformity of crosslinking reaction and particle size, and the difficulty of uniform dispersion, resulting in insufficient characteristics, for example, durability against hitting. A further attempt has been made to blend crosslinked silicone powder in a golf ball member, as disclosed in Japanese Patent Laid-open No. Hei 2001-170213. The golf ball member disclosed in this document, however, has a problem that since the silicone powder blended in the golf ball member is an ultra fine powder having an average particle size in a range of 0.5 to 50 $\mu$m, adhesiveness of a coating film tends to become insufficient.

To give the above-described various characteristics to a golf ball, it is essential to develop a new golf ball material, and recently, it is increasingly expected to develop a golf ball material capable of enhancing the resilience in a wide hitting head speed range so as to realize a further improved flight performance, and exhibiting stable ball characteristics in a wide temperature range.

SUMMARY OF THE INVENTION

An object of the present invention is to provide a golf ball formed from a material which is easy for molding, and which has a high resilience in a wide hitting head speed range, a high flexibility and a high durability against repetitive hitting in a wide temperature range, and an excellent adhesiveness of a coating film.

To achieve the above object, the present inventors have made studies, and found that by blending an appropriate amount of a powder having a polysiloxane structure, such as crosslinked silicone rubber powder or a crosslinked silicone resin powder which has a relatively large average particle size, in a golf ball-forming composition, it is possible to obtain a golf ball excellent in flight performance, durability against repetitive hitting, and adhesiveness of a coating film, as compared with the above-described related art golf ball in which an appropriate amount of a fine powder having a polysiloxane structure, such as a crosslinked silicone rubber powder or a crosslinked silicone resin powder which has a relatively small average particle size, is blended.

The present inventors have further found that by blending at least one kind selected from a crosslinked silicone rubber powder and a crosslinked silicone resin powder in the above-described golf ball-forming composition (used as a material for forming a center ball, a core, a cover, a cover layer, a one-piece (1P) golf ball, or the like), preferably, in an amount of 0.5 to 30% by weight, the golf ball formed by using such a material can exhibit excellent resilience, low-temperature characteristic, flight performance, durability against repetitive hitting, and adhesiveness of a coating film. On the basis of such knowledge, the present invention has been accomplished.

Accordingly, to achieve the above-described object, according to an aspect of the present invention, there is provided a golf ball including: a portion formed from a golf ball-forming composition containing at least one kind selected from a crosslinked silicone rubber powder and a crosslinked silicone resin powder; wherein each of the crosslinked silicone rubber powder and the crosslinked silicone resin powder has an average particle size in a range of 60 to 500 $\mu$m.

The crosslinked silicone rubber powder is preferably a powder obtained by crosslinking dimethyl polysiloxane and/or methylphenyl polysiloxane.

The crosslinked silicone resin powder is preferably a powder of hardened polyorgano silsesquioxanes.

The golf ball-forming composition preferably contains the crosslinked silicone rubber powder and/or the crosslinked silicone resin powder in an amount of 0.5 to 30% by weight.

Each of the crosslinked silicone rubber powder and the crosslinked silicone resin powder preferably has functional groups.

The golf ball-forming composition is preferably used as at least one kind of material selected from a group consisting of a one-piece golf ball material, a core material and a cover material for a two-piece golf ball, a core material, an intermediate layer material, and a cover material for a multi-piece golf ball having three pieces or more.

The golf ball-forming composition preferably mainly contains at least one kind selected from the group consisting of an ethylene based ionomer resin, a polyester based elastomer, a polyurethane based elastomer, a polyolefin based elastomer, a polyamide based elastomer, a polyolefin resin, and a styrene block copolymer.

DESCRIPTION OF THE PREFERRED EMBODIMENT

The present invention will be more fully described below. The golf ball of the invention is characterized in that at least one kind of hardened powder selected from a crosslinked silicone rubber powder and a crosslinked silicone resin powder is blended as an essential component in a golf ball-forming composition.

The crosslinked silicone rubber powder used herein may be a powder having a highly polymerized three-dimensional structure, which is obtained by crosslinking linear dimethyl polysiloxane and/or methylphenyl polysiloxane added with 0.05 mol % or more of vinyl groups by using methyl hydrogen polysiloxane as a crosslinking agent, or a powder modified therefrom, or may be a powder obtained by pulverizing a crosslinked silicone rubber. An appropriate silicone rubber powder is commercially available, for example, as an amorphous type (particle size: 300 $\mu$m, 60 $\mu$m) from Nikko Rica Co., Ltd.

The crosslinked silicone resin powder used herein may be a powder of hardened polyorgano silsesquioxanes obtained by hardening siloxane bonds in a three-dimensional network expressed by a formula $(RSiO_{3/2})_n$, or a powder modified therefrom. In the formula, it is recommended that R be $CH_3$, $C_6H_5$, or a long-chain alkyl group. The silicone resin powder may be used in the form of a spherical powder, an amorphous powder, a pulverized powder, or a modified type, for example, modified with vinyl groups, epoxy groups, amino groups, and the like.

Either of the silicone powders of the present invention is recommended to have an average particle size in a range of, generally, 60 $\mu$m or more, preferably, 80 $\mu$m or more, more preferably, 100 $\mu$m or more, with the upper limit being set to 500 $\mu$m or less, preferably, 400 $\mu$m or less, more preferably, 300 $\mu$m or less. Too small an average particle size of the silicone powder tends to degrade adhesiveness of a coating film, whereas too large an average particle size of the silicone powder tends to cause a difficulty in molding and to degrade the durability against hitting.

The golf ball of the present invention is characterized in that at least one constituent layer of the golf ball is formed from a golf ball-forming composition containing an appropriate amount of the above-described crosslinked silicone powder.

Irrespective of the kind of the silicone powder and the kind of a base polymer of the golf ball-forming composition, the content of the silicone powder in the base polymer may be in a range of, generally, 0.5 wt % or more, especially, 5 wt % or more, with the upper limit thereof being set to 30 wt % or less, especially, 10 wt % or less with respect to the weight of the base polymer of 100. Too large a content of the silicone powder tends to make it difficult to uniformly dispersing the silicone powder in the composition, and hence to reduce the resilience and the durability against repetitive hitting, whereas too small a content of the silicone powder often fails to sufficiently achieve the improvement effect by addition of the silicone powder.

According to the present invention, as described above, at least one constituent layer of the golf ball is formed from a golf ball-forming composition containing the silicone powder. Such a golf ball-forming composition may be any of well-known materials used in various golf balls, for example, rubbers or thermoplastic resins for centers of wound golf balls, rubbers or thermoplastic resins for cores or core layers of solid golf balls, rubbers or thermoplastic resins for outermost layers (covers) or inner layers of wound golf balls or solid golf balls.

Examples of base polymers of the golf ball-forming compositions used herein include polybutadiene containing 40 wt % or more of cis-1,4 bonds, styrene block copolymers, polyurethane based elastomers, polyester based elastomers, polyamide based elastomers, polyolefin based elastomers, polyolefin resins, and ethylene based ionomer resins.

The polybutadiene used as the base polymer of the golf ball-forming composition may contain cis-1,4 bonds in a range of 40 wt % or more as described above, more preferably, in a range of 70 wt % or more. Such polybutadiene is commercially available, for example, under the trade name of BRO1 from JSR Corporation.

The polybutadiene is typically used as the base polymer of the golf ball-forming composition suitable for forming a solid center of a wound golf ball, or a core or an inner layer except for an outer layer (cover) of a solid golf ball. More specifically, the polybutadiene containing 40 wt % or more of cis-1,4 bonds is advantageously used as the base polymer of the golf ball-forming composition suitable for forming a solid center of a wound golf ball or a core of a solid golf ball.

In the case of using the polybutadiene containing 40 wt % or more of cis-1,4 bonds as the base polymer of the golf ball-forming composition of the present invention, a crosslinking agent such as an unsaturated fatty acid, for example, acrylic acid or methacrylic acid, or a metal salt (such as zinc salt or magnesium salt) thereof, or zinc oxide or magnesium stearate may be used to crosslink the polybutadiene.

Examples of the styrene block copolymers used as the base polymers of the golf ball-forming compositions of the present invention include styrene-butadiene-styrene block copolymers (SB, SBS), styrene-isoprene-styrene block copolymers (SI, SIS), and hydrogenated products thereof (SEB, SEBS, SEP, SEPS), which are commercially available, for example, under the trade names of Cariflex TR and Kraton G from Shell Chemical Co. and Septon from Kuraray Co., Ltd.

Examples of the polyurethane based elastomers used as the base polymers of the golf ball-forming compositions of the present invention include well-known thermoplastic and thermosetting polyurethane based elastomers, which are commercially available, for example, under the trade name of Pandex from DIC Bayer Polymer Ltd.

Examples of the polyester based elastomers used as the base polymers of the golf ball-forming compositions of the present invention include well-known thermoplastic polyester based elastomers, which are commercially available, for example, under the trade name of Hytrel from DuPont-Toray Co., Ltd.

Examples of the polyamide based elastomers used as base polymers of the golf ball-forming compositions of the present invention include well-known thermoplastic polyamide based elastomers, which are commercially available, for example, under the trade name of Pebax from Toray Industries, Inc.

Examples of the polyolefin based elastomers used as the base polymers of the golf ball-forming compositions of the present invention include well-known dynamic crosslinking polyolefin based elastomers, which are commercially available, for example, under the trade names of Santoprene from Monsanto Co. and Dynaron (hydrogenated polybutadiene) from JSR Corporation.

Examples of the polyolefin resins used as the base polymers of the golf ball-forming compositions of the present invention include linear low-density polyethylene, ethylene-(meth)acrylic acid copolymers, and ethylene-(meth)acrylic acid-(meth)acrylate copolymers.

Examples of the ethylene based ionomer resins used as the base polymers of the golf-ball forming compositions of the present invention include copolymers of α-olefin and α,β-unsaturated carboxylic acid in which carboxyl groups are neutralized with mono or divalent metal ions, and copolymers of α-olefin, α,β-unsaturated carboxylic acid, and α,β-unsaturated carboxylate in which carboxyl groups are neutralized with mono or divalent metal ions. It is to be noted that the neutralization of carboxyl groups with metal ions is not necessarily fully performed but may be partially performed.

The α-olefin used for the copolymer as the ethylene based ionomer resin may be of a type having 2 to 8 carbon atoms, especially 2 to 6 carbon atoms. The α,β-unsaturated carboxylic acid used for the copolymer as the ethylene based ionomer resin may be acrylic acid, methacrylic acid, maleic acid, or fumaric acid. The α,β-unsaturated carboxylate used for the copolymer as the ethylene based ionomer resin may be an ester having about 4 to 12 carbon atoms, for example, methyl (meth)acrylate, ethyl (meth)acrylate, isobutyl (meth) acrylate, n-butyl (meth)acrylate, or 2-ethylhexyl (meth) acrylate. In particular, isobutyl (meth)acrylate is most preferably used.

The acid used for the copolymer as the ethylene based ionomer resin may be contained in the ionomer resin in a range of 5 to 25 wt %, preferably, 7 to 20 wt %, more preferably, 10 to 15 wt %. The (meth)acrylate used for the copolymer as the ethylene based ionomer resin may be contained in the ionomer resin in a range of 5 wt % or more, preferably, 8 wt % or more, with the upper limit thereof being set to 45 wt % or less, preferably, 30 wt % or less. Too small a content of the acid tends to reduce the resilience of the composition, whereas too large a content of the acid tends to reduce the flexibility of the composition. Too small a content of the (meth)acrylate tends to make it difficult to obtain a sufficient flexible composition, whereas too large a content of the (meth)acrylate tends to make the composition excessively flexible and hence to degrade characteristics such as a cut resistance of the composition.

Examples of the metal ions used for neutralization in preparing the copolymer as the ionomer resin include Na, Li, Zn, Mg, K and Ca. The degree of neutralization may be in a range of, generally, 10 mol % or more, preferably, 30 mol % or more, with the upper limit thereof being set to 90 mol % or less, especially, 80 mol % or less. Too low a degree of neutralization tends to reduce the resilience, whereas too high a degree of neutralization tends to cause a problem associated with flowability during molding.

The ethylene based ionomer resin used as the base polymer of the golf ball-forming composition may have a Shore D hardness of 40 to 80, preferably, 45 to 75.

An appropriate ethylene based ionomer resin used herein is commercially available, for example, under the trade name of Himilan from DuPont-Mitsui Polychemicals Co., Ltd., Surlyn from EI DuPont de Nemours & Company, or Iotek from ExxonMobil Chemical Company.

According to the present invention, each of the ethylene based ionomer resin and the olefin resin may be used as a material suitable for forming an inner layer or an outer layer (cover) of a multi-piece golf ball having three or more layers, especially, as the cover material for the multi-piece golf ball.

Each of the polyester based elastomer, the polyurethane based elastomer, the polyolefin based elastomer, the polyamide based elastomer, the polyolefin resin, and styrene block copolymer used as the base polymer of the golf ball-forming composition of the present invention may have a Shore D hardness in a range of 10 or more, preferably 20 or more, with the upper limit thereof being set to 50 or less, especially, 40 or less. Such a resin material having a hardness within the above range is advantageously used as a material to form a solid center of a wound golf ball, a core of a solid golf ball, and an inner layer of a multi-piece golf ball having three or more layers, especially, as the inner layer material of the multi-piece golf ball.

Depending on a portion (for example, a cover layer) of the golf ball to be formed from the golf ball-forming composition of the present invention, appropriate amounts of various additives may be blended in the above-described base polymer of the golf ball-forming composition. Examples of such additives include a pigment, a dispersant, an antioxidant, and a UV absorber. An inert filler such as zinc oxide, barium sulfate, titanium dioxide, silica, calcium carbonate, or zinc carbonate, and further, polyethylene wax and metal soap may be also added in the base polymer for adjustment of a specific gravity in accordance with the standards of golf balls and for coloring.

According to the invention, the crosslinked silicone powder is blended in the above-described golf ball-forming composition in accordance with an appropriate blending method known in the art. For example, in the case of blending the silicone powder in polybutadiene rubber, a mixture of the silicone powder and the polybutadiene rubber may be kneaded by using a commonly used kneader for rubber, for example, a Banbury mixer or roll mill. In the case of blending the silicone powder in a thermoplastic resin, a mixture of the silicone powder and the thermoplastic resin may be kneaded by using a commonly used kneader for resin, for example, a uniaxial or biaxial extruder or a roll mill.

A core, an intermediate layer, or an outer layer of the golf ball of the present invention may be formed by any of general golf ball molding methods. For example, in the case of molding the core by using polybutadiene rubber as the base polymer of the golf ball-forming composition, the rubber composition is compression or injection molded in a core-forming mold and is thermally cured at a temperature being high enough to make a crosslinking agent and a co-crosslinking agent active, to form a core. In this core molding, if dicumyl peroxide is used as the crosslinking agent and zinc acrylate is used as the co-crosslinking agent, the thermal curing may be performed at about 130 to 170° C. for 5 to 40 min.

Each of the intermediate layer and the outer layer (cover) may be molded from the golf ball-forming composition containing a thermoplastic resin as the base polymer by any of general golf ball molding methods. For example, the core prepared by the above method is placed in a mold, and then the thermoplastic resin composition is compression or injection molded so as to cover the core, to form the intermediate layer or the cover.

The shape of each of the layers thus formed is not particularly limited; however, the core may have a diameter of 25 mm or more, especially 27 mm or more, with the upper limit thereof being set to 42 mm or less, especially, 40 mm or less; the solid center may have a diameter of 15 mm or more, especially, 20 mm or more, with the upper limit thereof being set to 40 mm or less, especially, 38 mm or less. If the diameter of each of the core or the solid center is outside the above range, the resilience and/or durability against repetitive hitting may become insufficient. The one-piece (1P) solid golf ball preferably has a diameter of 40 mm to 43 mm so that it may have an approximate outer diameter as the authorized golf ball.

In the case of using the golf-ball composition of the present invention for a wound golf ball, the composition is advantageously used to form a solid center, an intermediate layer or a cover (enclosing the thread rubber layer). It is to be noted that the wound golf ball includes a wound core obtained by winding a rubber thread around a solid center or a liquid center.

Each of a wound core, an inner layer, and an outer layer of the wound golf ball may be formed by any of common methods. For example, the wound core may be formed by winding a rubber thread around the center. The thread rubber layer thus formed may have a thickness of 1 mm or more, especially, 1.5 mm or more, with the upper limit thereof being set to 4.4 mm or less, especially, 4.0 mm or less. If the thickness of the thread rubber layer is outside the above range, there may occur a problem associated with the reduced resilience or durability against repetitive hitting.

In the case of forming each of an intermediate layer and an outer layer of a multi-piece golf ball having three or more layers by using the golf ball-forming composition of the present invention, the thickness of the layer may be in a range of 0.5 mm or more, especially, 1 mm or more, with the upper limit thereof being set to 3 mm or less, especially, 2.5 mm or less. If the thickness of the layer is outside of above range, there may occur a problem associated with the reduced resilience and durability against repetitive hitting.

Each of the intermediate layer and the outer layer of the multi-piece golf ball may have a Shore D hardness in a range of 15 to 80, preferably, 25 to 70. In particular, the Shore D hardness of the intermediate layer (inner layer) may be in a range of 20 to 75, preferably, 30 to 60, and the Shore D hardness of the outer layer (cover) may be in a range of 40 to 80, preferably, 45 to 65. If the hardness of each of the intermediate layer and the cover is outside the above range, there may occur a problem associated with the reduced resilience and durability against repetitive hitting and the degraded feel of hitting.

The golf ball of the present invention has, in its surface, a multiplicity of dimples. The geometrical arrangement of dimples may be an octahedral or icosahedral arrangement and the dimple pattern may be any of square, hexagon, pentagon, and triangle patterns.

The diameter and weight of the golf ball of the present invention may be specified in accordance with the Rules of Golf, for example, with the diameter specified in a range of 42.67 mm or more and the weight specified in a range of 45.93 g or less.

EXAMPLE

The present invention will be described in more detail with reference to the following examples, although not limited thereto.

Examples and Comparative Example

Components of each of core-forming compositions shown in Table 1 were kneaded in a Banbury mixer and the resultant mixture was molded at 155° C. for 15 min in accordance with a well-known method, to thus obtain a core.

In Tables 1 to 3, characters "BR01", "H1706", "H1605", "AM7317", "AM7318", "KMP597", and "300 μm" denote the names of materials used for producing golf balls, as follows:

BR01: polybutadiene rubber produced by JSR Corporation

H1706: Zn based ionomer resin produced by DuPont-Mitsui Polychemicals Co., Ltd.

H1605: Na based ionomer resin produced by DuPont-Mitsui Polychemicals Co., Ltd.

AM7317: Zn based ionomer resin produced by DuPont-Mitsui Polychemicals Co., Ltd.

AM7318: Na based ionomer resin produced by DuPont-Mitsui Polychemicals Co., Ltd.

KMP597: silicone rubber powder (spherical type, average particle size: 5 μm, particle size distribution: 1 to 10 μm, true specific gravity; 0.97, moisture content: 0.1%) produced by Shin-Etsu Chemical Co., Ltd.

300 μm: pulverized silicone rubber powder (amorphous type, average particle size: 300 μm) produced by Nikko Rica Co., Ltd.

TABLE 1

| | | a |
|---|---|---|
| Composition of material for core (Parts by weight) | Polybutadiene BR01 | 100 |
| | Zinc acrylate | 22 |
| | Dicumyl peroxide | 1.4 |
| | Zinc oxide | 23 |
| | Antioxidant | 0.1 |

Components of each of outer layer-forming resin compositions shown in Tables 2 and 3 were blended by a biaxial extruder, to form a cover (outer layer) around the core previously prepared, to produce a golf ball.

Each of the golf balls thus obtained was evaluated as follows. The results are shown in Tables 2 and 3.

[Hardness]

The hardness of each of a core and a product was determined by measuring a deflection of the core or the product under an applied load of 100 kg.

[Initial Velocity]

The initial velocity at each of 23° C. and 3° C. was measured by an initial velocity tester specified under USGA (United States Golf Association).

[Temperature Dependency of Initial Velocity]

The temperature dependency of the initial velocity was determined by comparing the initial velocity at room temperature (23° C.) with the initial velocity at a low temperature (3° C.).

[Hitting Head Speed Dependency of Initial Velocity]

The hitting head speed dependency of the initial velocity was determined by measuring the initial velocity of a golf ball hit at each of head speeds (HS) of 35 m/s and 45 m/s by a hitting tester (driver, #1W) produced by True Temper Company, and comparing the initial velocity at 35 m/s with the initial velocity at 45 m/s.

[Flight Distance]

The flight distance was determined by measuring the carry and total distance of a golf ball hit at a head speed of 35 m/s by the hitting tester (driver, #1W) produced by true Temper Company.

[Durability Against Hitting]

The durability of a golf ball against hitting was determined by repeatedly hitting a golf ball at a head speed of 40 m/s by using a durability tester (driver, #1W), to repeatedly give an impact equivalent to the head speed of 40 m/s to the golf ball. In this test, the upper limit of the number of repetitive hitting was set to 300 times, and five balls were test for each kind of the golf balls in Examples 1 to 4 and Comparative Examples 1 to 6 and the number of the cracked balls and an average value of the numbers of repetitive hitting at which the balls were cracked were measured.

[Sand/Water Wear Test]

The degree of peeling of a coating film on a golf ball was determined by putting the golf ball, together with abrasive (Shorel Nugget SN, size 5S, produced by Showa Denko K. K.), in a pot mill (volume: about 4 liters), polishing the golf ball at 30 rpm for each of 2 hr and 4 hr, and visually evaluating the degree of peeling of the coating film on the basis of the following criterion:

◎ : no peeling

Δ: partial peeling

X: peeling in wide range

TABLE 2

| | | | Example | | | |
|---|---|---|---|---|---|---|
| | | | 1 | 2 | 3 | 4 |
| Material (Parts by weight) | Core | (Table 1) | a | a | a | a |
| | Cover (Outer layer) | H1706 | 50 | | 50 | |
| | | H1605 | 50 | | 50 | |
| | | AM7318 | | 50 | | 50 |
| | | AM7317 | | 50 | | 50 |
| | | 300 μm | 5 | 5 | 10 | 10 |
| | | Titanium dioxide | 3 | 3 | 3 | 3 |

TABLE 2-continued

| | | | Example | | | |
|---|---|---|---|---|---|---|
| | | | 1 | 2 | 3 | 4 |
| Structure | Core | Outer diameter (mm) | 38.9 | 38.9 | 38.9 | 38.9 |
| | | Hardness (mm) | 3.9 | 3.9 | 3.9 | 3.9 |
| | | Weight (g) | 36.0 | 36.0 | 36.0 | 36.0 |
| | | Initial velocity (m/s) at 23° C. | 76.30 | 76.30 | 76.30 | 76.30 |
| | Product | Outer diameter (mm) | 42.7 | 42.7 | 42.7 | 42.7 |
| | (Coated with paint after formation of outer layer) | Hardness (mm) | 3.5 | 3.3 | 3.6 | 3.4 |
| | | Weight (g) | 45.3 | 45.3 | 45.4 | 45.4 |
| | | Initial velocity (m/s) at 23° C. | 77.10 | 77.30 | 77.00 | 77.20 |
| | | Initial velocity (m/s) at 3° C. | 76.20 | 76.40 | 76.20 | 76.41 |
| | | Initial velocity at 23° C. - Initial velocity at 3° C. | 0.90 | 0.90 | 0.80 | 0.79 |
| | | Initial velocity at HS = 45 m/s | 67.9 | 68.2 | 67.9 | 68.1 |
| | | Initial velocity at HS = 35 m/s | 54.2 | 54.5 | 54.2 | 54.4 |
| | | Initial velocity at 45 m/s - Initial velocity at 35 m/s | 13.7 | 13.7 | 13.7 | 13.7 |
| Flight characterisitic | Flight distance (HS = 35 m/s) | Carry (m) | 161.3 | 162.4 | 161.3 | 162.3 |
| | | Total (m) | 172.5 | 173.3 | 172.4 | 173.4 |
| Durability against hitting | Number of cracked balls/ Total number of tested balls | | 0/5 | 0/5 | 0/5 | 0/5 |
| | Average of numbers of repetitive hitting at which balls are cracked (Upper limit of repetitive hitting: 300 times) | | no crack | no crack | no crack | no crack |
| Sand/Water wear test | 2 hr | | ◎ | ◎ | ◎ | ◎ |
| | 4 hr | | ◎ | ◎ | ◎ | ◎ |

TABLE 3

| | | | Comparative Example | | | | | |
|---|---|---|---|---|---|---|---|---|
| | | | 1 | 2 | 3 | 4 | 5 | 6 |
| Material (Parts by weight) | Core | (Table 1) | a | a | a | a | a | a |
| | Cover (Outer layer) | H1706 | 50 | | 50 | | 50 | |
| | | H1605 | 50 | | 50 | | 50 | |
| | | AM7317 | | 50 | | 50 | | 50 |
| | | AM7318 | | 50 | | 50 | | 50 |
| | | KMP597 | | | 5 | 5 | 10 | 10 |
| | | Titanium dioxide | 3 | 3 | 3 | 3 | 3 | 3 |
| Structure | Core | Outer diameter (mm) | 38.9 | 38.9 | 38.9 | 38.9 | 38.9 | 38.9 |
| | | Hardness (mm) | 3.9 | 3.9 | 3.9 | 3.9 | 3.9 | 3.9 |
| | | Weight (g) | 36.0 | 36.0 | 36.0 | 36.0 | 36.0 | 36.0 |
| | | Initial velocity (m/s) at 23° C. | 76.30 | 76.30 | 76.30 | 76.30 | 76.30 | 76.30 |

TABLE 3-continued

| | | | Comparative Example | | | | | |
|---|---|---|---|---|---|---|---|---|
| | | | 1 | 2 | 3 | 4 | 5 | 6 |
| | Product (Coated with paint after formation of outer layer) | Outer diameter (mm) | 42.7 | 42.7 | 42.7 | 42.7 | 42.7 | 42.7 |
| | | Hardness (mm) | 3.4 | 3.2 | 3.5 | 3.3 | 3.6 | 3.4 |
| | | Weight (g) | 45.2 | 45.2 | 45.3 | 45.3 | 45.4 | 45.4 |
| | | Initial velocity (m/s) at 23° C. | 76.91 | 77.27 | 77.00 | 77.28 | 76.91 | 77.19 |
| | | Initial velocity (m/s) at 3° C. | 75.76 | 76.10 | 76.07 | 76.35 | 76.03 | 76.30 |
| | | Initial velocity at 23° C. - Initial velocity at 3° C. | 1.15 | 1.17 | 0.93 | 0.93 | 0.88 | 0.89 |
| | | Initial velocity at HS = 45 m/s | 67.9 | 68.2 | 68.0 | 68.3 | 67.9 | 68.2 |
| | | Initial velocity at HS = 35 m/s | 53.7 | 54.0 | 54.0 | 54.3 | 53.9 | 54.2 |
| | | Initial velocity at 45 m/s - Initial velocity at 35 m/s | 14.2 | 14.2 | 14.0 | 14.0 | 14.0 | 14.0 |
| Flight characteristic | Flight distance (HS = 35 m/s) | Carry (m) | 159.3 | 161.3 | 160.8 | 161.9 | 160.3 | 161.8 |
| | | Total (m) | 170.4 | 171.9 | 171.9 | 172.8 | 171.4 | 172.9 |
| Durability against hitting | Number of cracked balls/ Total number of tested balls | | 5/5 | 5/5 | 2/5 | 2/5 | 0/5 | 0/5 |
| | Average of numbers of repetitive hitting at which balls are cracked (Upper limit of repetitive hitting: 300 times) | | 220 | 200 | 300 | 290 | no crack | crack crack |
| Sand/Water wear test | | 2 hr | ◎ | ◎ | ◎ | ◎ | Δ | Δ |
| | | 4 hr | ◎ | ◎ | Δ | Δ | Δ | Δ |

As is apparent from the results shown in Tables 1 and 2, when compared with each of the golf ball added with no silicone rubber powder and the golf ball added with a fine silicone rubber powder having an average particle size of 5 μm in Comparative Examples, the two-piece golf ball configured such that an appropriate amount of the silicone rubber powder having a particle size of 300 μm is added to the ionomer resin forming the outer layer is excellent in resilience, flight characteristic, durability against hitting, and adhesiveness of a coating film.

As described above, the golf ball of the present invention is excellent in durability against repetitive hitting and adhesiveness of a coating film, and particularly, has a good resilience and a long flight distance in both a wide temperature range and a wide hitting head speed range.

While the preferred embodiment of the present invention has been described using the specific terms, such description is for illustrative purposes only, and it is to be understood that changes and modifications may be made without departing from the spirit and scope of the following claims.

What is claimed is:

1. A golf ball comprising:

an outermost layer formed from a composition which mainly contains at least one kind selected from the group consisting of an ethylene based ionomer resin, a polyester based elastomer, a polyurethane based elastomer, a polyolefin based elastomer, a polyamide based elastomer, a polyolefin resin, and a styrene block copolymer, and contains at least one kind selected from a crosslinked silicone rubber powder and a crosslinked silicone resin powder;

wherein each of said crosslinked silicone rubber powder and said crosslinked silicone resin powder has an average particle size in a range of 60 to 500 μm.

2. A golf ball according to claim 1, wherein said crosslinked silicone rubber powder is a powder obtained by crosslinking dimethyl polysiloxane and/or methylphenyl polysiloxane.

3. A golf ball according to claim 1, wherein said crosslinked silicone resin powder is a powder of hardened polyorgano silsesquioxanes.

4. A golf ball according to claim 1, wherein said golf ball-forming composition contains said crosslinked silicone rubber powder and/or said crosslinked silicone resin powder in an amount of 0.5 to 30% by weight.

5. A golf ball according to claim 1, wherein each of said crosslinked silicone rubber powder and said crosslinked silicone resin powder has functional groups.

6. A golf ball according to claim 1, the average particle size of each of the crosslinked silicone rubber powder is in a range of 80 to 400 μm.

7. A golf ball according to claim 1, the average particle size of each of the crosslinked silicone rubber powder is in a range of 100 to 300 μm.

* * * * *